US005261246A

United States Patent [19]

Blackmon et al.

[11] Patent Number: 5,261,246

[45] Date of Patent: Nov. 16, 1993

[54] APPARATUS AND METHOD FOR PURGING A REFRIGERATION SYSTEM

[76] Inventors: John G. Blackmon, 2019 Queens Rd. East, Charlotte, N.C. 28207; William S. Blackmon, 2110 Sagamore Rd., Charlotte, N.C. 28209

[21] Appl. No.: 957,580

[22] Filed: Oct. 7, 1992

[51] Int. Cl.[5] ..... F25B 47/00

[52] U.S. Cl. ..... 62/85; 62/475

[58] Field of Search ..... 62/85, 149, 195, 292, 62/475, 77

[56] References Cited

U.S. PATENT DOCUMENTS

| | | | |
|---|---|---|---|
| 3,145,544 | 8/1964 | Weller | 62/475 |
| 3,410,106 | 12/1968 | Brockie | 62/475 |
| 3,664,147 | 5/1972 | Blackmon . | |
| 3,688,515 | 9/1972 | Lavigne, Jr. . | |
| 4,304,102 | 12/1981 | Gray . | |
| 4,984,431 | 1/1991 | Mount et al. . | |
| 5,018,361 | 5/1991 | Kroll et al. . | |

*Primary Examiner*—John M. Sollecito

*Attorney, Agent, or Firm*—Bell, Seltzer, Park & Gibson

[57] ABSTRACT

A purge apparatus for removing foreign non-condensable gases from a refrigeration system including a closed purge chamber adapted to receive the foreign gases together with a portion of the refrigerant from the high pressure region of the system. The purge chamber is cooled to condense the refrigerant, and a float actuated electrical switch is provided within the purge chamber to open a first valve for discharging the condensed refrigerant back to the evaporator of the refrigeration system upon the refrigerant reaching a predetermined level, and open a second valve for venting the non-condensable gases to the atmosphere through a gas discharge line upon a drop in the refrigerant level. A heated gas separating tank is positioned in the gas discharge line, which serves to separate any gaseous refrigerant entrained with the contaminating non-condensable gases and cause the gaseous refrigerant to be returned to the cool purge chamber where they may be condensed.

24 Claims, 1 Drawing Sheet

APPARATUS AND METHOD FOR PURGING A REFRIGERATION SYSTEM

BACKGROUND OF THE INVENTION

The present invention relates to a refrigeration system, and more particularly to an apparatus and method for purging non-condensable gases from a refrigeration system.

In a conventional refrigeration system, particularly in low pressure centrifugal compressor systems, the leakage of air, water vapor, and other contaminating foreign gases into the system is a recognized problem. Such gases reduce the efficiency of the system since they tend to elevate the total pressure in the condenser, and thus more power is required from the compressor per unit of refrigeration. Also these foreign gases tend to cling to the condenser tubes thereby reducing the total condensing surface area.

To remove these foreign gases from the system, it is common practice to draw a mixture of the gaseous refrigerant and foreign gases from the high pressure region in the condenser or receiver where they normally accumulate, condense the refrigerant and any water vapor by cooling or by compression and cooling, vent off the non-condensables, separate and drain the water, and return the condensed refrigerant to the low pressure region of the system. The purge unit itself typically comprises a separation chamber wherein the non-condensables gather above the liquid refrigerant and water. A pressure actuated mechanical relief valve automatically opens to vent the non-condensables to the atmosphere through a gas discharge line, and a manual drain is provided to drain off the water which floats on top of the liquid refrigerant. A mechanical valve adjacent the bottom of the purge chamber is opened by a float when the refrigerant reaches a predetermined level to drain the refrigerant through a refrigerant line and return it to the low pressure region of the system.

U.S. Pat. No. 3,664,147 to Blackmon discloses a purge apparatus of the described type and which includes an electric float switch in the purge chamber and which is connected to a pair of solenoid actuated valves for (1) discharging a portion of the condensed refrigerant back through the refrigerant line to the low pressure region of the refrigeration system when the level of condensed refrigerant rises above a predetermined level, and (2) venting the non-condensable gases to the atmosphere through the gas discharge line when the level of the condensed refrigerant drops below a predetermined level. The apparatus described in the referenced patent has been commercialized in a configuration wherein a compressor is provided in the gas discharge line to facilitate withdrawal of the gas from the purge chamber, which is particularly useful when low operating pressures are utilized in the refrigeration system.

While the apparatus described in the above referenced patent is highly efficient, it is recognized that a small amount of non-condensed refrigerant may remain with the contaminating non-condensable gases in the purge chamber and be vented to the atmosphere through the gas discharge line during the purging operation.

It is accordingly an object of the present invention to further improve the efficiency of a purge apparatus of the described type by substantially eliminating the venting of any non-condensed refrigerant to the atmosphere during the purging operation.

It is a further object of the present invention to provide a purge apparatus of the described type which is economical to manufacture and which is effective and efficient in use.

SUMMARY OF THE INVENTION

The above and other objects and advantages of the present invention are achieved in the embodiment illustrated herein by the provision of a purge apparatus which comprises a closed purge chamber, a mixed gas inlet line connected between the high pressure region of the refrigeration system and the purge chamber for introducing refrigerant and any non-condensable gases from the high pressure region into the purge chamber, and means for cooling the purge chamber to at least substantially condense the refrigerant therein. A first outlet is provided for periodically discharging a portion of the condensed refrigerant from the purge chamber to the low pressure region of the refrigeration system, and second outlet is provided for periodically discharging any non-condensable gases from the purge chamber to the atmosphere, and which includes a gas discharge line communicating with the purge chamber and discharging to the atmosphere. A gas separation tank is provided which communicates with the gas discharge discharge line, and means are provided for heating the gas separation tank. Also, a valve is provided at a location downstream of the separation tank for periodically opening the gas discharge line to the atmosphere such that the non-condensable gases are withdrawn from the gas separation tank and released to the atmosphere.

In accordance with the present invention, it has been discovered that during periods when the valve closes the gas discharge line, any non-condensed gaseous refrigerant in the separation tank will slowly migrate back to the purge chamber. It is believed that this migration occurs as a result of the temperature difference between the heated separation tank and the cooled purge chamber. As a result, the heated separating tank serves to retain the contaminating noncondensable gases, and these gases may be withdrawn to the atmosphere during the relatively short periods of time when the gas discharge line is vented to the atmosphere.

BRIEF DESCRIPTION OF THE DRAWING

Some of the objects and advantages of the invention having been stated, others will appear when the description proceeds when taken in conjunction with the accompanying drawing, which comprises a schematic illustration of a typical refrigeration system incorporating the improved purge apparatus of the present invention.

DETAILED DESCRIPTION OF THE PREFERRED EMBODIMENT

Figure 1:
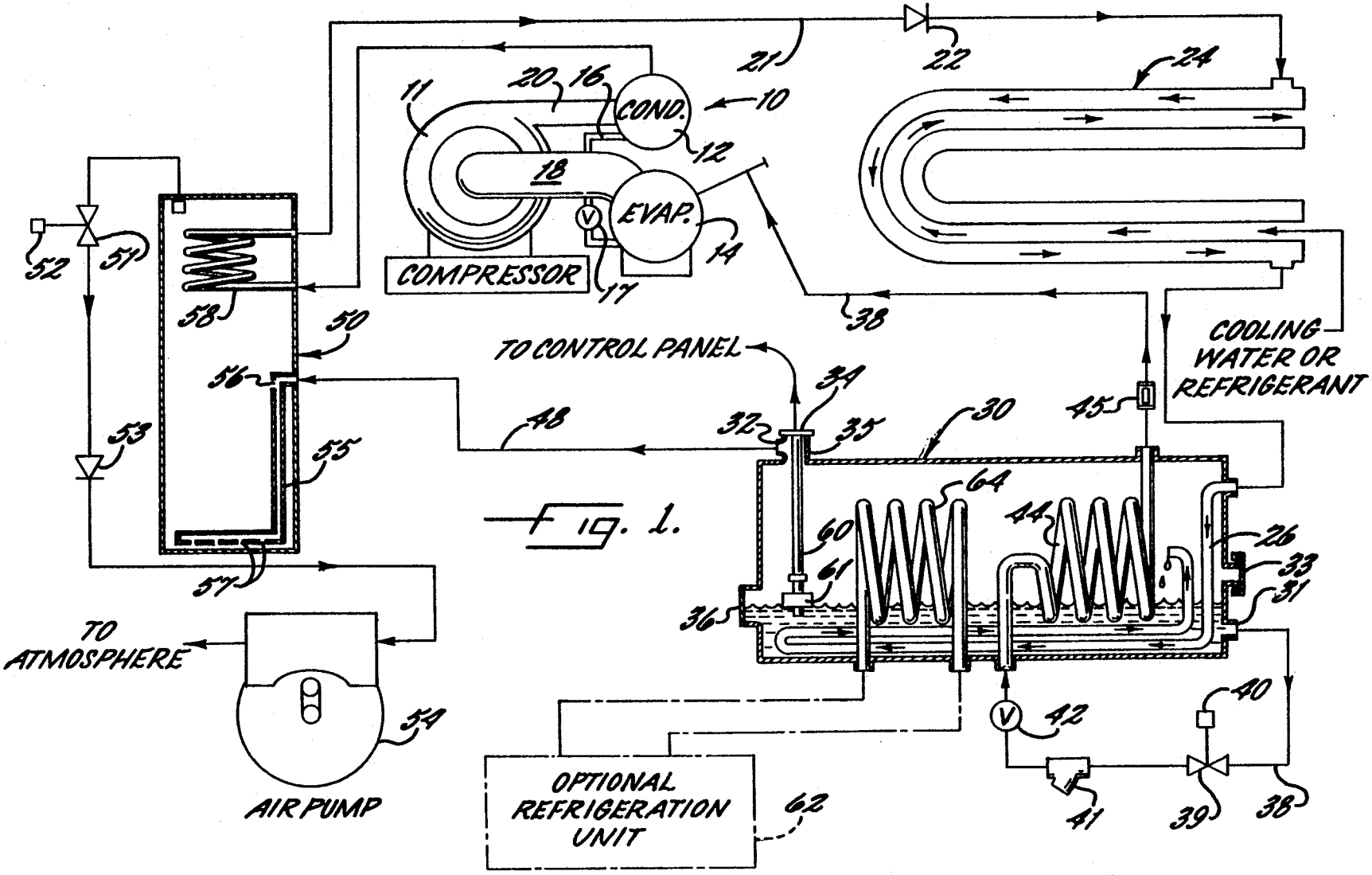

Referring more particularly to the drawings, a refrigeration apparatus embodying the novel features of the present invention is illustrated schematically. The apparatus includes a conventional refrigeration system 10 which includes a centrifugal compressor 11, a condenser 12, and a cooler or evaporator 14. A line 16 conducts the condensed refrigerant between the condenser 12 and the evaporator 14, and the line 16 includes a conventional restriction or expansion valve 17, which divides the system into a high pressure region in the condenser and a low pressure region in the evaporator. The line 18 provides a path of flow for the gaseous refrigerant formed in the evaporator 14 to the compressor 10, where the pressure of the refrigerant is elevated. The pressurized gaseous refrigerant is then discharged through line 20 to the condenser 12 to complete the refrigeration cycle.

Since the low pressure region of the above described refrigeration system is commonly below atmospheric pressure, it is subject to air-in leakage. The water vapor and non-condensable gases which enter with the air collect in the upper portion of the condenser 12 and mix with the gaseous refrigerant. A mixed gas inlet line 21 is provided for removing these gases from the condenser. The line 21 may include a check valve 22 and it leads through a condensing apparatus 24 where the refrigerant and water vapor are at least partially condensed. The condensing apparatus 24 may be supplied with cooling water or other cooling medium to facilitate the cooling operation. From the condensing apparatus 24, the line 21 leads to a tube 26 positioned within the interior of a purge chamber 30, and the tube 26 opens into the interior of the chamber 30.

The purge chamber 30 comprises a closed vessel which may, for example, be in the configuration of an elongated tubular member with closed parallel opposite ends. The outer walls are preferably covered with a heat insulating material (not shown) to reduce heat transfer.

The refrigerant and water vapor passing through the line 21 and tube 26 will have been substantially condensed in the condensing apparatus 24, and thus these components will enter the chamber 30 essentially in liquid form and collect at the bottom thereof. The water, being lighter than the condensed refrigerant, will float on top. The non-condensable gases entering the vessel will collect in the upper region thereof.

The chamber 30 includes a first outlet 31 adjacent the bottom for draining the condensed refrigerant therefrom, a second outlet 32 adjacent the top for venting the non-condensable gases, and a third outlet 33 positioned at a level intermediate the first and second outlets for discharging any water floating on the top of the refrigerant. A manually removable cap 34 is operatively positioned to close a further outlet 35 and mount a float switch in the chamber 30 as further described below. Also, the chamber 30 may include a glass observation port 36 in one end wall for the purposes described below.

The first outlet 31 of the purge chamber 30 is connected to a refrigerant line 38 which leads through a valve 39 controlled by the solenoid 40, through a strainer 41, and then through a restriction or expansion valve 42. The line 38 then communicates with a coil 44 positioned within the chamber 30, and the line 38 then exits the chamber 30 and continues to the evaporator 14 of the refrigeration system 10. The line 38 may include a sight glass 45 downstream of the chamber 30.

The second outlet 32 adjacent the top of the chamber 30 is connected to a gas discharge line 48 which passes through a gas separating tank 50, and then continues through a second valve 51 which is controlled by a solenoid 52, then through a check valve 53, and finally through an air pump 54 and to the atmosphere.

In the illustrated embodiment, the gas separating tank 50 is in the form of an upright cylindrical tube having closed upper and lower ends, and the portion of the gas discharge line 48 leading from the purge chamber 30 communicates with an internal tube 55 at an entry point which is typically located at about the midportion of the height of the tank 50. The internal tube 55 includes an opening 56 of relatively small size adjacent the entry point of the gas discharge line 48, and the internal tube 55 then extends downwardly to a location adjacent the bottom of the tank where other openings 57 of larger size are located.

The upper portion of the interior of the tank mounts a tube coil 58, which forms a portion of the mixed gas inlet line 21. Since relatively hot pressurized gases flow through the line 21 and thus the coil 58, the tank 50 is thereby heated. This provides an energy efficient heat source, since the gases in the line 21 must in any event be cooled. The tank 50 is also preferably covered with a heat insulating material (not shown) to reduce heat transfer to the surrounding air.

Positioned within the purge chamber 30 is a float actuated electric switch 60 which is controlled by the level of the refrigerant (and any water) in the chamber. Generally, the switch 60 includes a magnet equipped float 61, and is designed to actuate relays (not shown) which control the opening and closing of the valves 39 and 51. More particularly, during normal operation of the system, the valve 39 is open and the valve 51 is closed. With the valve 39 open, the condensed refrigerant flows through the refrigerant line 38 back to the evaporator 14. In the process, the condensed refrigerant expands after having passed the expansion valve 42, so that the refrigerant passing through the coil 44 absorbs heat and cools the chamber. This cooling facilitates the condensation of the gaseous portion of the refrigerant received in the chamber from the mixed gas inlet line 21.

When the level of the refrigerant drops below a predetermined level, the float actuated switch 60 acts to open the valve 51 in the gas discharge line 48, and close the valve 39. Since the pressure in the chamber 30 and the tank 50 is normally above atmospheric pressure, the gases in the tank 50 will thus exhaust to the atmosphere. Where the refrigeration system operates at lower pressures, such as when R-113 refrigerant is utilized, the pressure in the chamber 30 and tank 50 may be at or slightly below atmospheric pressure, and in this case, the air pump 54 at the outlet end of the gas discharge line 48 is actuated concurrently with the opening of the valve 51 so as to withdraw gases from the tank 50. When the level of the refrigerant in the chamber 30 returns to the predetermined level, the switch 60 acts to return the valves 39 and 51 to their normal operating positions, i.e. the valve 39 is opened and the valve 51 is closed.

A further description of the float actuated switch 60 may be obtained from the above referenced U.S. Pat. No. 3,664,147, the disclosure of which is expressly incorporated herein by reference.

The apparatus of the present invention may further include a separate refrigeration unit 62 which has an evaporator coil 64 positioned within the purge chamber 30. The additional cooling capacity provided by this separate refrigeration unit 62 assures maximum condensation of the refrigerant in the chamber.

In operation, the purge chamber 30 receives the partially condensed refrigerant and water vapor, as well as the non-condensable gases, from the mixed gas inlet line 21. The condensed refrigerant and water collect at the bottom of the chamber 30 until the float 61 is raised to a level sufficient to close the switch which opens the initially closed valve 39 in the manner described above.

The condensed refrigerant then flows through the line 38 and the expansion valve 42 and into the coil 44 located within the chamber 30. The expansion valve 42 causes the pressure to drop within the coil to approximately the pressure in the low pressure region, and the refrigerant therein to evaporate. This in turn cools the interior of the chamber, lowering its temperature to approach that of the evaporator 14, and causing the refrigerant and water vapor not previously condensed in the chamber 30 to be condensed. The evaporated refrigerant in the coil 44 is returned to the evaporator 14 of the main system via the remainder of the refrigerant line.

In cases where air is leaking into the system, the non-condensable gases of the leaking air will in time collect in the upper portion of the chamber 30, and the resulting pressure build-up will cause the level of the condensed refrigerant to be lowered. When the refrigerant level in the chamber 30 drops below the predetermined level, the float acts to close valve 39 and open valve 51 in the manner described above. As indicated above, the air pump 54 may be concurrently actuated, in cases where the internal pressures are at or below atmospheric pressure. The non-condensable gases which have accumulated above the liquid level then move through the gas discharge line 48 to the separation tank 50 and then vent to the atmosphere.

It is recognized that the purge chamber 30 may not condense all of the refrigerant, and thus a small amount of the non-condensed refrigerant may move with the other contaminating non-condensable gases through the gas discharge line 48 and into the tank 50 when the valve 51 is opened. It will also be understood that when the valve 51 is opened, the pressure in the tank 50 and purge chamber 30 is lowered, which tends to suck in more refrigerant from the inlet line 21. This additional refrigerant tends to raise the refrigerant level, until the valve 51 is closed and the valve 39 is opened. Thus the valve 51 is opened for very brief intervals which depend upon the amount of air leakage into the system, and these intervals may for example be only about ten seconds every few hours.

As an important aspect of the present invention, it has been found that during the extended quiescent periods when the valve 51 is closed and the valve 39 is open, any gaseous refrigerant which reaches the heated separation tank 50 will tend to migrate back to the cool purge chamber 30. The reason for this migration is believed to be related to the fact that the tank 50 is heated, and the purge chamber 30 is cool, and the gaseous refrigerant appears to be repelled by the heat of the tank 50 and attracted by the coolness of the purge chamber 30. As a result, the tank 50 will in time purge itself of substantially all of the gaseous refrigerant which reaches the tank during a previous opening of the valve 51, and when the valve 51 is next opened, it releases only the noncondensable gases to the atmosphere and substantially no refrigerant.

As illustrated in the drawing, the top of the separation tank 50 is preferably positioned above the level of the top of the purge chamber 30. This is believed to facilitate the movement of air through the line 48 toward the warm upper portion of the tank 50 during normal operation. Also, the presence of the small opening 56 adjacent the upper end of the tube 55 is believed to facilitate this movement, while any gaseous refrigerant settles to the bottom of the tank 50 and is able to migrate back to the chamber 30 through the openings 57. The upper opening 56 is preferably quite small, and is in the nature of a small orifice, so as to preclude a significant quantity of air from passing into the tank 50 through the opening 56 during the purging sequence.

Any water which may be floating on top of the refrigerant may be periodically drained through the water outlet 33 by manually removing its cap. The glass observation port 36 on the end wall of the purge chamber is used to facilitate observation of the water level.

In certain applications, it may be desirable to place a charcoal filled bag (not shown) in the separation tank 50. It is believed that the charcoal will have a tendency to retain any gaseous refrigerant which is in the tank during the opening of the valve 51 and thus prevent the release of any such refrigerant to the atmosphere during the purging operation.

The above described purging system is essentially automatic, and will operate whenever the compressor 11 of the main refrigeration system 10 is running.

In the drawings and specification, there has been set forth a preferred embodiment of the invention, and although specific terms are employed, they are used in a generic and descriptive sense only and not for purposes of limitation.

That which is claimed is:

1. A purge apparatus for removing non-condensable gases from the refrigerant in a refrigeration system having a relatively high pressure region and a relatively low pressure region, comprising a closed purge chamber, a mixed gas inlet line connected between said high pressure region of said refrigeration system and said purge chamber for introducing refrigerant and any non-condensable gases from said high pressure region into said purge chamber, means for cooling said purge chamber to at least substantially condense the refrigerant therein, first outlet means for periodically discharging a portion of the condensed refrigerant from said purge chamber to said low pressure region of said refrigeration system, and second outlet means for periodically discharging any non-condensable gases from said purge chamber to the atmosphere, and including a gas discharge line communicating with said purge chamber and discharging to the atmosphere, a gas separation tank communicating with said gas discharge discharge line, means for heating said gas separation tank, and valve means for periodically opening said gas discharge line to the atmosphere such that the non-condensable gases may be withdrawn from said gas separation tank and released to the atmosphere, and whereby during periods when said valve means is closed, any gaseous refrigerant in said separation tank may migrate back to said purge chamber through said gas discharge line.

2. The purge apparatus as defined in claim 1 wherein said means for heating said gas separation tank comprises a portion of said mixed gas inlet line which is positioned within the interior of said gas separation tank.

3. The purge apparatus as defined in claim 2 further comprising means for cooling said mixed gas inlet line at a location between said high pressure region and said purge chamber so as to at least partially condense the refrigerant passing therethrough.

4. A purge apparatus for removing non-condensable gases from the refrigerant in a refrigeration system having a relatively high pressure region and a relatively low pressure region, comprising a closed purge chamber, a mixed gas inlet line connected between said high pressure region of said refrigeration system and said purge chamber for introducing the refrigerant and any non-condensable gases from said high pressure region into said purge chamber, means for cooling said purge chamber to at least substantially condense the refrigerant therein, first outlet means including a refrigerant line extending from said purge chamber to said low pressure region of said refrigeration system, a first valve positioned in said refrigerant line, and first switch means for opening said first valve so as to discharge a portion of the condensed refrigerant from said purge chamber to said low pressure region of said refrigeration system when the level of condensed refrigerant in said purge chamber is above a predetermined level, second outlet means including a gas discharge line communicating with said purge chamber and discharging to the atmosphere, a second valve positioned in said gas discharge line, a gas separation tank communicating with said gas discharge line at a location between said purge chamber and said second valve, means for heating said gas separation tank, and second switch means for periodically opening said second valve to withdraw the gases from said gas separation tank and release the same to the atmosphere upon the level of the condensed refrigerant in said purge chamber being below a predetermined level, and whereby during periods when said second valve is closed, any gaseous refrigerant in said separation tank may migrate back to said purge chamber through said gas discharge line.

5. The purge apparatus as defined in claim 4 wherein said means for heating said gas separation tank comprises a portion of said mixed gas inlet line which is positioned within the interior of said gas separation tank.

6. The purge apparatus as defined in claim 5 wherein said means for cooling said purge chamber comprises a portion of said refrigerant line which is positioned in heat exchange relationship with the interior of said purge chamber, and an expansion valve positioned in said refrigerant line upstream of said portion thereof, so that the condensed refrigerant passing therethrough expands and absorbs heat from the interior of said purge chamber.

7. The purge apparatus as defined in claim 6 wherein said means for cooling said purge apparatus further comprises a separately operable refrigeration unit having an evaporator coil positioned in heat exchange relationship with the interior of said purge chamber.

8. The purge apparatus as defined in claim 5 further comprising means for cooling said mixed gas input line at a location between said high pressure region and said purge chamber so as to at least partially condense the refrigerant passing therethrough.

9. The purge apparatus as defined in claim 8 wherein said first outlet means further includes an expansion valve positioned in said refrigerant line, and said means for cooling said purge chamber comprises a portion of said refrigerant line which is downstream of said expansion valve and is positioned within the interior of said purge chamber, so that the condensed refrigerant passing through said refrigerant line expands and absorbs heat from the interior of said purge chamber.

10. The purge apparatus as defined in claim 9 wherein said second outlet means further comprises a gas pump positioned in said gas discharge line downstream of said separation tank.

11. The purge apparatus as defined in claim 4 wherein said first and second switch means comprise a common switch which is operable between a first position wherein said first valve is closed and said second valve is open, and a second position wherein said first valve is open and said second valve is closed.

12. The purge apparatus as defined in claim 5 wherein said gas separation tank is of substantial height and includes an internal tube which is connected to the portion of said gas discharge line leading from said purge chamber at an entry point which is located at a medial portion of the height of said tank, and wherein said internal tube extends downwardly from said entry point and includes discharge opening means adjacent the bottom of said tank.

13. The purge apparatus as defined in claim 12 wherein said internal tube further includes an outlet orifice of relatively small size adjacent said entry point.

14. The purge apparatus as defined in claim 12 wherein said gas separation tank includes an upper portion which is above the elevation of said purge chamber, and wherein said portion of said mixed gas inlet line which is within the interior of said tank is positioned in said upper portion thereof.

15. In a refrigeration system comprising a compressor, a relatively high pressure region including a condenser, a relatively low pressure region including an evaporator, the combination therewith of a purge apparatus for removing non-condensable gases from the refrigerant which comprises a closed purge chamber, a mixed gas inlet line connected between said high pressure region of said refrigeration system and said purge chamber for introducing the refrigerant and any non-condensable gases from said high pressure region into said purge chamber, means for cooling said purge chamber to at least substantially condense the refrigerant therein, first outlet means including a refrigerant line extending from said purge chamber to said low pressure region of said refrigeration system, a first valve positioned in said refrigerant line, and first switch means for opening said first valve so as to discharge a portion of the condensed refrigerant from said purge chamber to said low pressure region of said refrigeration system when the level of condensed refrigerant in said purge chamber is above a predetermined level, second outlet means including a gas discharge line communicating with said purge chamber and discharging to the atmosphere, a second valve positioned in said gas discharge line, a gas separation tank communicating with said gas discharge line at a location between said purge chamber and said second valve, means for heating said gas separation tank, and second switch means for periodically opening said second valve to withdraw the gases from said gas separation tank and release the same to the atmosphere upon the level of the condensed refrigerant in said purge chamber being below a predetermined level, and whereby during periods when said second valve is closed, any gaseous refrigerant in said separation tank may migrate back to said purge chamber through said gas discharge line.

16. The refrigeration system as defined in claim 15 wherein said means for heating said gas separation tank comprises a portion of said mixed gas inlet line which is positioned within the interior of said gas separation tank, and wherein said means for cooling said purge chamber comprises a portion of said refrigerant line which is positioned in heat exchange relationship with the interior of said purge chamber, and an expansion valve positioned in said refrigerant line upstream of said portion thereof, so that the condensed refrigerant passing therethrough expands and absorbs heat from the interior of said purge chamber.

17. The refrigeration system as defined in claim 15 further comprising means for cooling said mixed gas input line at a location between said high pressure region and said purge chamber so as to at least partially condense the refrigerant passing therethrough.

18. A method of purging non-condensable gases from a refrigeration system which comprises a compressor, a condenser, an evaporator, a purge chamber, a mixed gas inlet line communicating between said condenser and said purge chamber, a refrigerant line communicating between said purge chamber and said evaporator, and a gas discharge line communicating with said purge chamber and discharging to the atmosphere, and comprising the steps of providing a gas separation tank in said gas discharge line, periodically exhausting gas to the atmosphere from said separation tank and through said gas discharge line so as to cause the non-condensed gases and any non-condensed refrigerant to flow from said purge chamber to said separation tank, heating the gas separation tank so that during periods when the separation tank is not exhausting to the atmosphere, the non-condensable gases are caused to separate from any gaseous refrigerant and the gaseous refrigerant migrates back to said purge chamber while the non-condensable gases remain in said separation tank.

19. The method as defined in claim 18 comprising the further step of cooling the purge chamber.

20. The method as defined in claim 19 wherein the step of heating the gas separation tank includes positioning a portion of said mixed gas inlet line in heat exchange relationship with said gas separation tank so that heat from the gas passing through said mixed gas inlet line is transferred to said gas separation tank.

21. The method as defined in claim 20 comprising the further step of cooling the mixed gas inlet line at a location intermediate the condenser and the purge chamber so as to cool and at least partially condense the refrigerant passing therethrough.

22. The method as defined in claim 21 wherein the step of periodically exhausting gas to the atmosphere from said separation tank comprises exhausting the tank only when the level of condensed refrigerant in said purge chamber is below a predetermined level.

23. The method as defined in claim 19 wherein the step of cooling the purge chamber includes positioning the refrigerant line so as to pass through the interior of said purge chamber, and positioning an expansion valve in said refrigerant line so that the condensed refrigerant passing therethrough expands and absorbs heat from the interior of said purge chamber.

24. The method as defined in claim 23 wherein the step of cooling the purge chamber further includes positioning a valve in said refrigerant line, and opening said valve only when the level of condensed refrigerant in said purge chamber is above a predetermined level.

* * * * *